US006829850B2

(12) United States Patent
Goode

(10) Patent No.: US 6,829,850 B2
(45) Date of Patent: Dec. 14, 2004

(54) SLIDE BOOK FOR VIEWING TRANSLUCENT GLAZES

(76) Inventor: Sunny S. Goode, 2821 Floyd Ave., Richmond, VA (US) 23220

( * ) Notice: Subject to any disclaimer, the term of this patent is extended or adjusted under 35 U.S.C. 154(b) by 9 days.

(21) Appl. No.: 10/310,296

(22) Filed: Dec. 4, 2002

(65) Prior Publication Data

US 2004/0107614 A1 Jun. 10, 2004

(51) Int. Cl.[7] ..... G09F 3/00
(52) U.S. Cl. ..... 40/124.01; 40/675
(58) Field of Search ..... 40/536, 124.01, 40/124, 191, 446, 530, 534, 537, 124.4, 675; 434/98, 103; 281/27.1, 27.2

(56) References Cited

U.S. PATENT DOCUMENTS

| | | | | | |
|---|---|---|---|---|---|
| 402,859 | A | | 5/1889 | Rose | |
| 935,474 | A | | 9/1909 | Eckart | |
| 2,748,498 | A | | 11/1956 | Stuart et al. | |
| 2,889,937 | A | * | 6/1959 | Best | 211/46 |
| 4,078,325 | A | * | 3/1978 | Valentine | 40/388 |
| 4,104,809 | A | * | 8/1978 | Day et al. | 434/104 |
| 4,457,718 | A | | 7/1984 | Lerner | |
| 4,557,772 | A | | 12/1985 | Crist, Jr. | |
| 4,652,470 | A | * | 3/1987 | Das et al. | 427/407.1 |
| 5,015,073 | A | | 5/1991 | Cole | |
| 5,743,407 | A | * | 4/1998 | Williams | 206/575 |
| 5,985,413 | A | | 11/1999 | Boyle et al. | |
| 6,217,934 | B1 | * | 4/2001 | Eilenberger | 427/8 |
| 2002/0092221 | A1 | * | 7/2002 | DaRif et al. | 40/674 |

* cited by examiner

*Primary Examiner*—Mark T. Le
(74) *Attorney, Agent, or Firm*—Thomas F. Bergert; Williams Mullen, P.C.

(57) ABSTRACT

This invention provides a slide book that more accurately reveals a finished wall treatment. The slide book is comprised of a plurality of display slides. The slides are comprised of various translucent glazes, washes and patinas. To see how the finished wall color treatment will look, a consumer places one of the display slides directly over the base coat color of choice.

16 Claims, 4 Drawing Sheets

SLIDE BOOK FOR VIEWING TRANSLUCENT GLAZES

BACKGROUND OF THE INVENTION

It is a recent trend in wall color treatment to apply translucent color glazes, color washes and patinas over background paint. Color washes are light in pigment and designed to go over a base coat. The walls absorb the color wash, creating a stained effect that resembles old, fresco plaster. Glazes are transparent and pre-tinted to create the illusion of depth. Patinas are glazes containing more brown, earthy pigments, which make the walls look aged. They can be used over any color wash, glaze or base coat paint.

When selecting a custom wall treatment, consumers cannot readily visualize the finished product prior to its application to the base coat. There exists a need for a consumer to be able to review various customized wall treatments prior to such application.

SUMMARY OF THE INVENTION

This invention provides a slide book that accurately reveals a finished wall treatment. The slide book is comprised of a plurality of display slides. Said slides are comprised of various translucent glazes, washes and patinas. To see how the finished wall color treatment will look, a consumer places one of the display slides directly over the base coat color of choice.

It is an object of this invention to provide an improved display slide for viewing translucent glazes, washes and patinas.

It is another object of this invention to provide an improved slide book that facilitates the review and comparison of various customized wall treatments prior to their application on a product surface.

Other features and advantages of the invention will become apparent to those of ordinary skill the art upon review of the following detailed description, claims and drawings.

BRIEF DESCRIPTION OF THE DRAWINGS

The attributes and advantages of this invention can be better understood by reference to the following detailed description, when taken in conjunction with the accompanying drawings. In the attached drawings, "Figure" is abbreviated as "Fig.".

DESCRIPTION OF THE PREFERRED EMBODIMENTS

Figure 1:
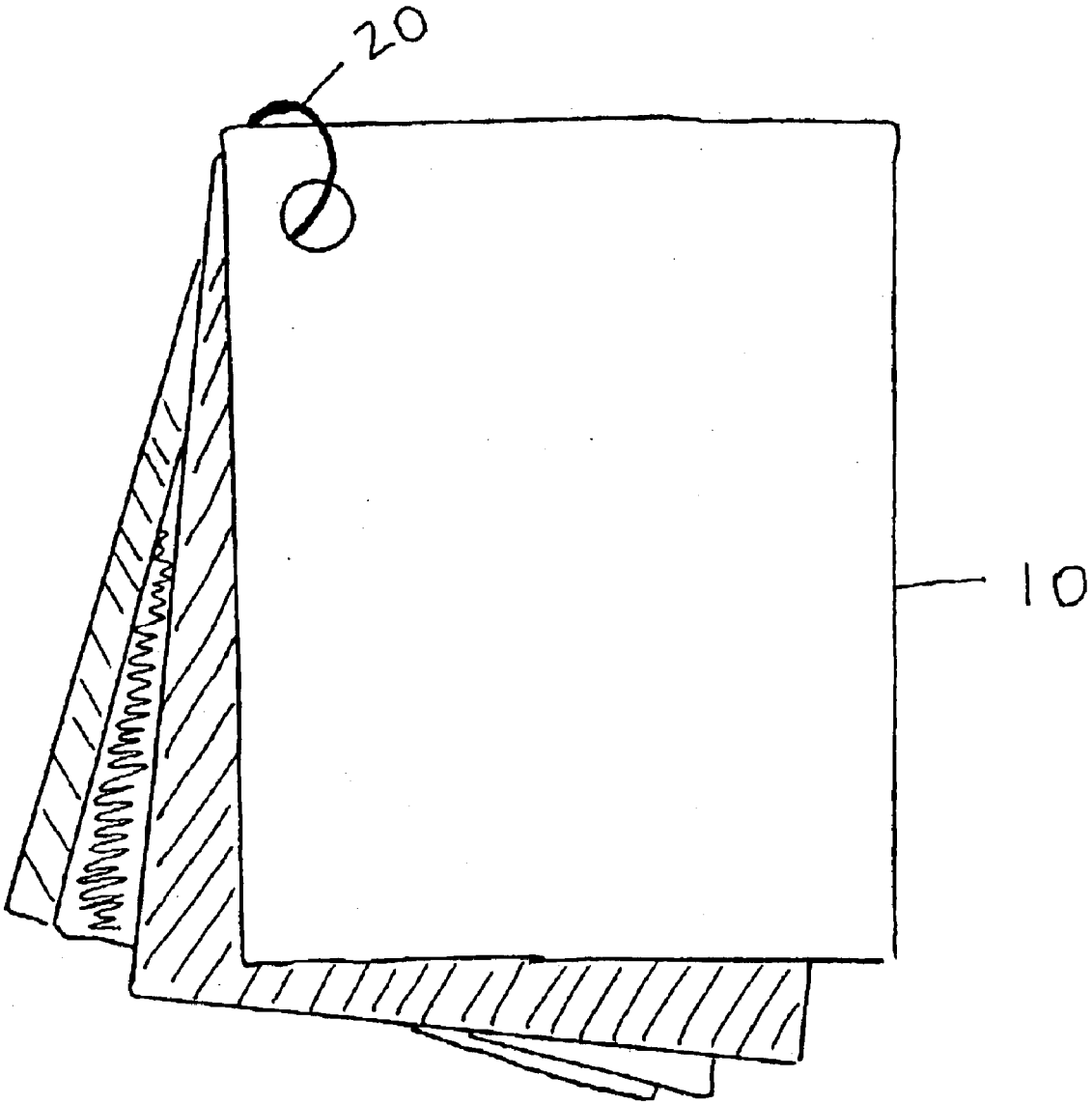
FIG. 1 shows the slide book.
Figure 2:
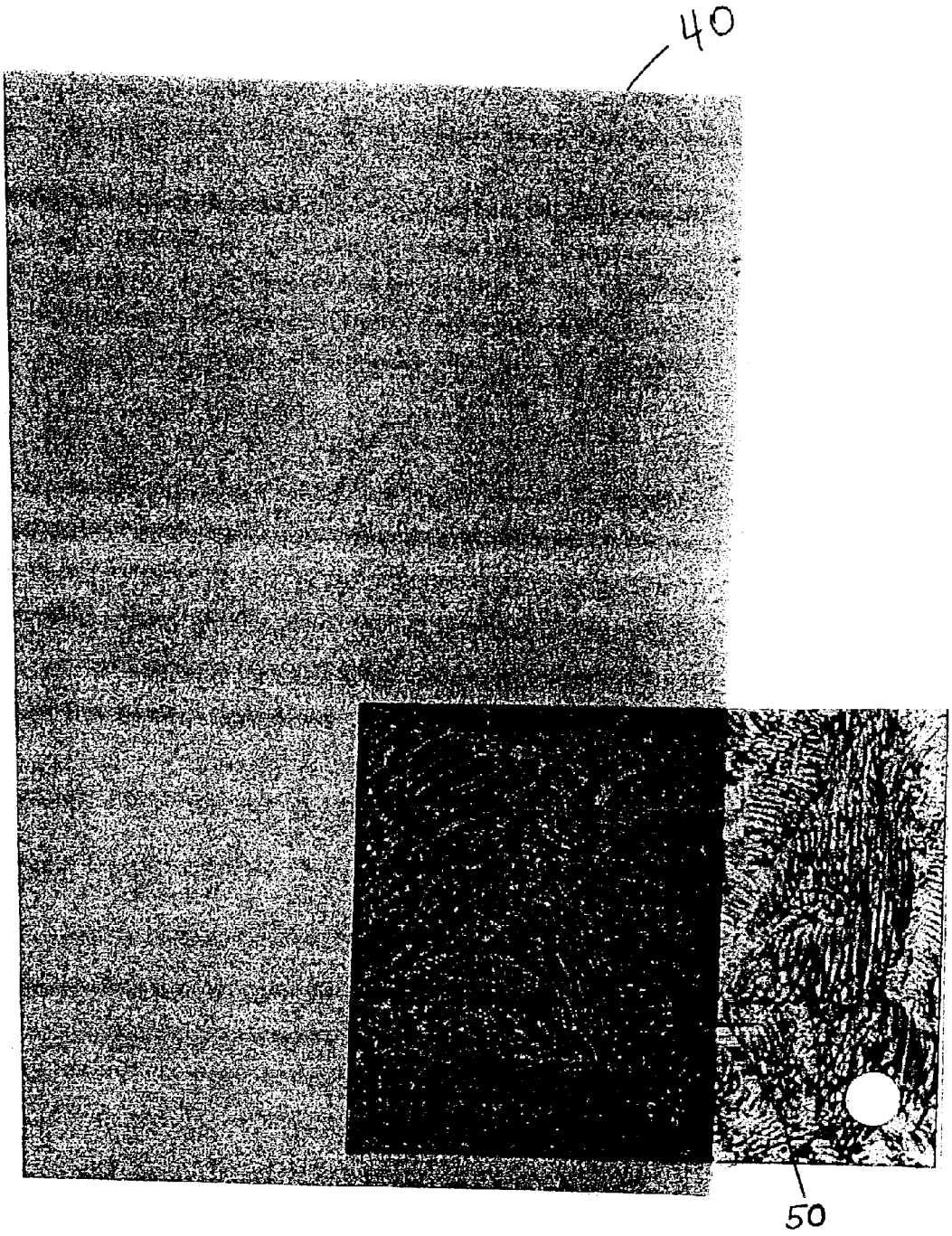
FIG. 2 shows an individual glaze display slide placed over a base coat.
Figure 3:
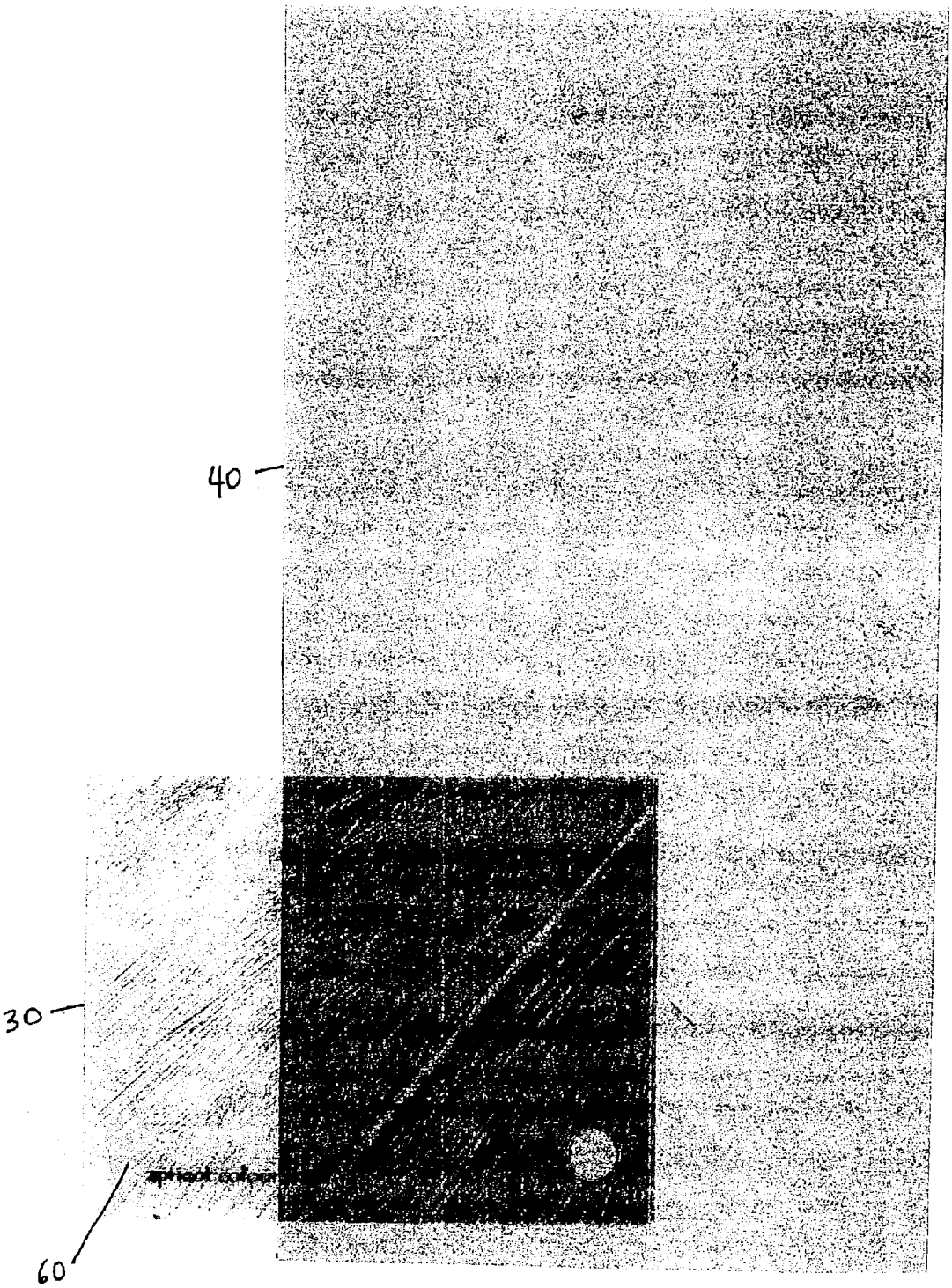
FIG. 3 shows an individual color wash display slide placed over a base coat.
Figure 4:
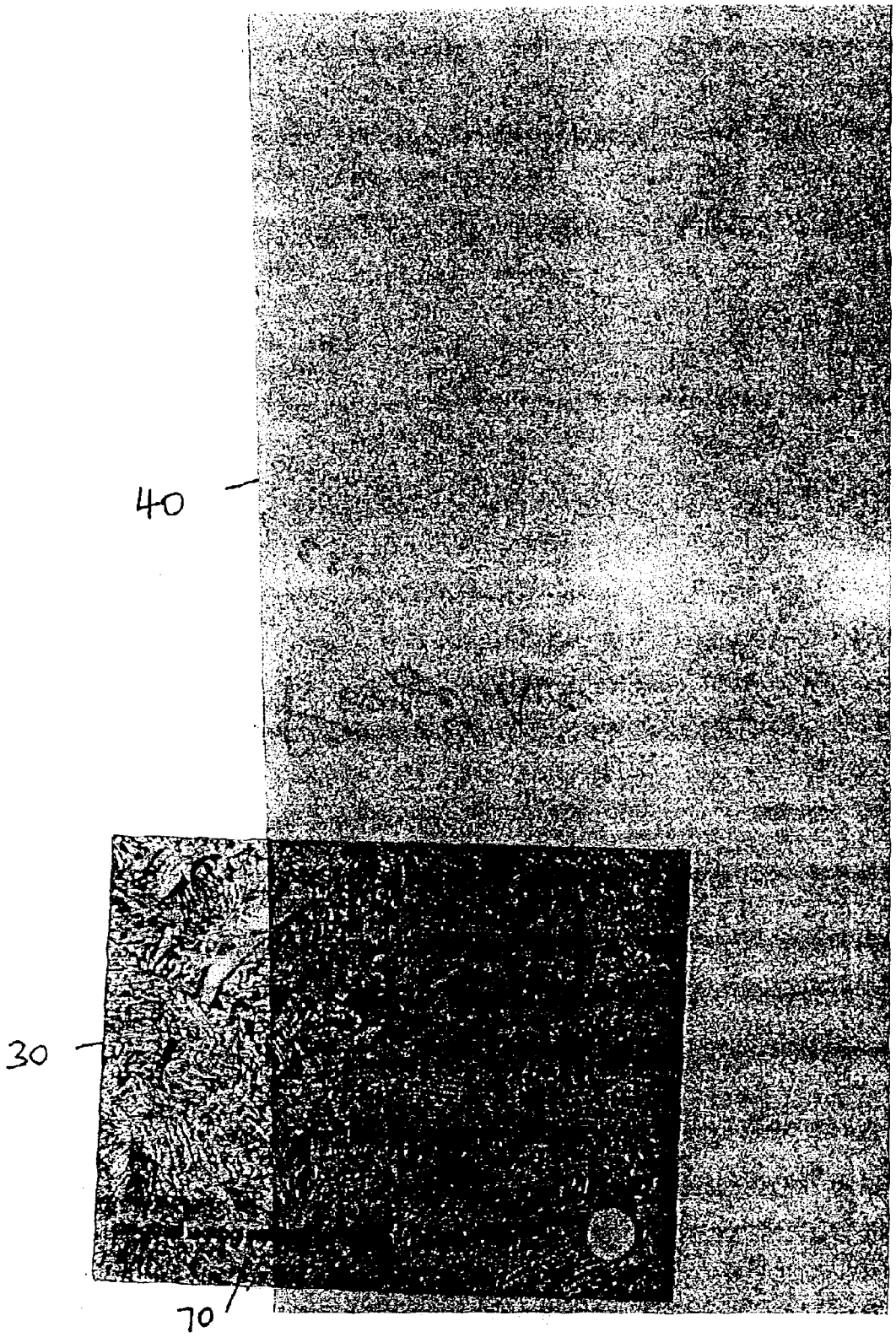
FIG. 4 shows an individual patina display slide placed over a base coat.

Referring now to the drawings, FIG. 1 shows the slide book embodying the invention. FIGS. 2–4 demonstrate the display slide in use with a sample base coat.

In a preferred embodiment, the slide book 10 comprises a plurality of individual display slides 30. Each display slide 30 demonstrates a different customized color treatment. In one embodiment, the display slides are comprised of various glazes 50, washes 60 and patinas 70.

The slide book 10 facilitates easy comparison between various techniques. One method of securing the display slides into a slide book is with a ring 20, preferably, a ¾ inch metal ring. The metal ring 20 is detachable thereby easily enabling the addition/removal of display slides.

The individual display slides are preferably made by applying the desired glaze 50, wash 60 or patina 70 to clear acetate. Said acetate preferably ranges in depth from about 3 millimeters to about 15 millimeters. Once the product is dry, a backing of clear laminate or ultra-violet coating is preferably applied to one side. In one embodiment, the display slide 30 is rectangular in shape and about 3½ inches by 2¾ inches. This size is large enough for the consumer to review what the finished product will look like, but small enough for the consumer to conveniently carry.

From the foregoing description, it may be seen that a device formed in accordance with the present invention incorporates many novel features over and offers significant advantages over those currently available. While the presently preferred embodiment of the invention has been illustrated and described, various changes can be made without exceeding the scope of the invention.

I claim:

1. A display slide for viewing customized paint treatment comprising:

a clear acetate support base;

a first coating applied to said base, wherein said first coating is selected from the group consisting of a glaze, a color wash and a patina; and a second clear coating applied to said first coating.

2. The display slide of claim 1 wherein said second coating is selected from the group consisting of clear laminate and an ultra-violet coating.

3. The display slide of claim 1 wherein said slide is about 3 millimeters to about 15 millimeters thick.

4. The display slide of claim 1 wherein said slide has a rectangular shape.

5. The display slide of claim 4 wherein said slide is about 3½ inches by about 2¾ inches.

6. The display slide of claim 1 wherein said first coating is a glaze.

7. The display slide of claim 1 wherein said first coating is a color wash.

8. The display slide of claim 1 wherein said first coating is a patina.

9. A book for viewing customized paint treatments comprising a plurality of the display slides of claim 1.

10. The book of claim 9 wherein said slides are fastened together with a metal ring.

11. A method for reviewing a customized paint treatment comprising:

applying the display slide of claim 1 directly over a base coat.

12. A method of making a display slide for viewing customized paint treatment comprising the steps of:

providing a clear acetate support base;

applying a first coating to said base wherein said first coating is selected from the group consisting of a glaze, a color wash and a patina; and applying a second clear coating to said first coating.

13. The method of claim 12 wherein said second coating is selected from the group consisting of a clear laminate and an ultraviolet coating.

14. The method of claim 12 wherein said first coating is a glaze.

15. The method of claim 12 wherein said first coating is a color wash.

16. The method of claim 12 wherein said first coating is a patina.

* * * * *